US007281550B2

(12) United States Patent
Ziegler

(10) Patent No.: US 7,281,550 B2
(45) Date of Patent: Oct. 16, 2007

(54) LIQUID DELIVERY SYSTEM WITH HORIZONTALLY DISPLACED DISPENSING POINT

(75) Inventor: Alan T. Ziegler, Santa Cruz, CA (US)

(73) Assignee: Cryotech International, Inc., Campbell, CA (US)

( * ) Notice: Subject to any disclaimer, the term of this patent is extended or adjusted under 35 U.S.C. 154(b) by 377 days.

(21) Appl. No.: 10/890,246

(22) Filed: Jul. 13, 2004

(65) Prior Publication Data

US 2005/0011580 A1 Jan. 20, 2005

Related U.S. Application Data

(60) Provisional application No. 60/538,565, filed on Jan. 23, 2004, provisional application No. 60/510,907, filed on Oct. 14, 2003, provisional application No. 60/487,022, filed on Jul. 14, 2003.

(51) Int. Cl.
*B65B 1/20* (2006.01)

(52) U.S. Cl. ..... 141/82; 141/11; 141/69; 141/103; 53/431; 62/52.1

(58) Field of Classification Search ..... 141/9, 141/11, 69, 82, 103, 167; 53/431, 432; 62/52.1
See application file for complete search history.

(56) References Cited

U.S. PATENT DOCUMENTS

| | | | | |
|---|---|---|---|---|
| 3,556,174 | A * | 1/1971 | Gibble et al. | 141/69 |
| 4,588,000 | A * | 5/1986 | Malin et al. | 141/1 |
| 5,607,861 | A * | 3/1997 | Komatsu et al. | 436/50 |
| 5,743,096 | A | 4/1998 | Blanton et al. | |
| 6,182,715 | B1 | 2/2001 | Ziegler et al. | |
| 6,519,919 | B1 * | 2/2003 | Takenouchi et al. | 53/431 |

* cited by examiner

*Primary Examiner*—Timothy L. Maust
(74) *Attorney, Agent, or Firm*—Craig M. Stainbrook; Stainbrook & Stainbrook, LLP

(57) ABSTRACT

A method and apparatus for the efficient and controllable delivery of cryogen liquid droplets into thin walled containers. Discharge of the droplets is facilitated using a horizontal displacement assembly to transport metered droplets from a liquid dosing unit to the point of injection above the container. The horizontal displacement assembly may be provided with internal heaters to prevent freeze up, and a sensor to confirm droplet discharge. It may also be provided with a separate source of heated nitrogen gas, which can be used to back purge the dispensing unit should it become clogged, to melt any frozen liquid occlusions which may have formed in the cryogen supply line.

26 Claims, 9 Drawing Sheets

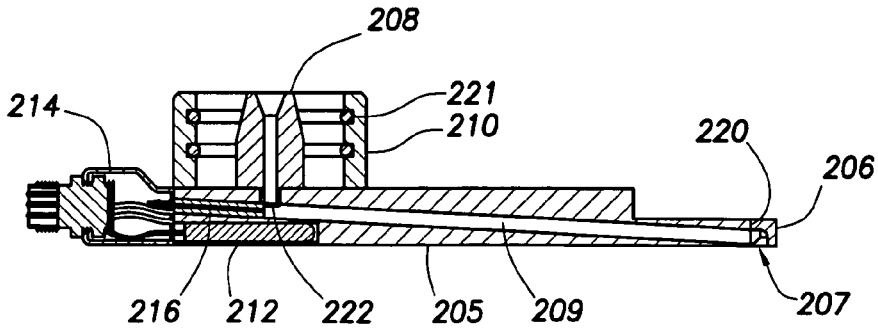
FIG.5A
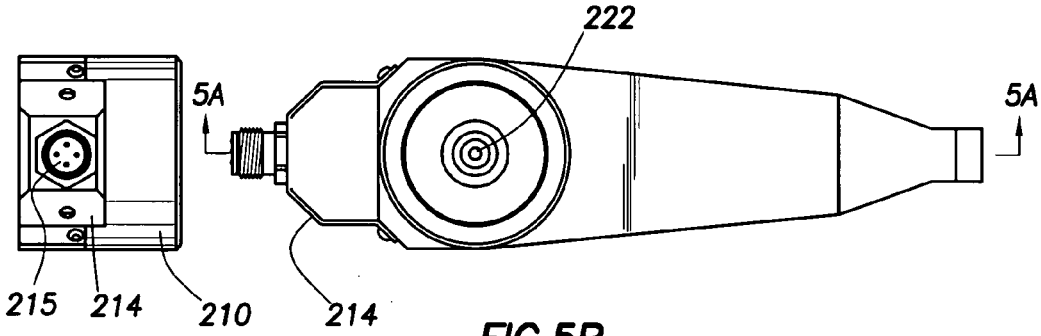
FIG.5E
FIG.5B
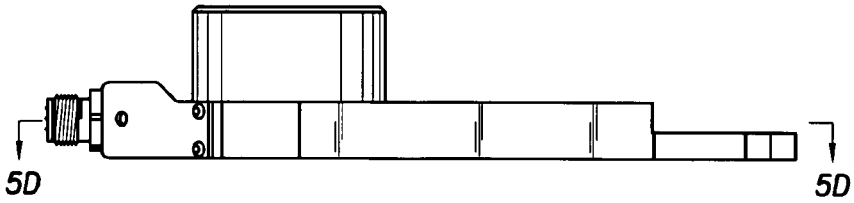
FIG.5C
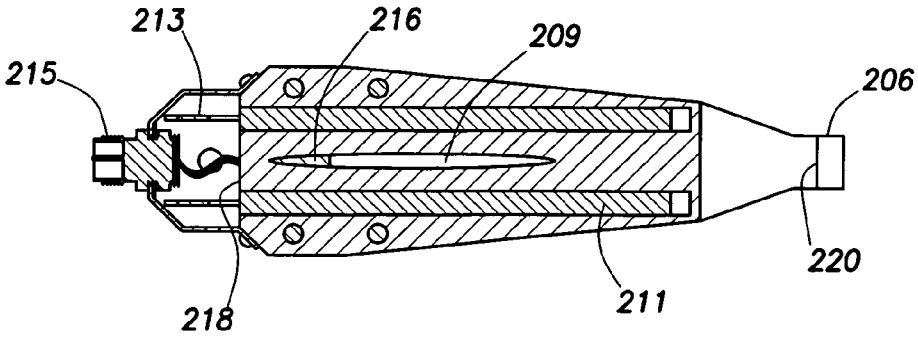
FIG.5D

LIQUID DELIVERY SYSTEM WITH HORIZONTALLY DISPLACED DISPENSING POINT

CROSS-REFERENCE TO RELATED APPLICATIONS

This application claims benefit of U.S. provisional patent application Ser. No. 60/487,022, filed Jul. 14, 2003; U.S. provisional patent application Ser. No. 60/510,907, filed Oct. 14, 2004; and U.S. provisional patent application Ser. No. 60/538,565, filed Jan. 23, 2004, all of which are herein incorporated by reference.

BACKGROUND OF THE INVENTION

1. Field of the Invention

The present invention relates generally to cryogenic liquid delivery systems and more particularly to managed dosing systems for injecting metered droplets of liquid nitrogen into beverage, food or other product containers as they move along high-speed production lines before being sealed.

2. Description of the Related Art

With thin walled containers, especially thin walled metal cans and plastic bottles, it has been found useful to stiffen them after filling, but prior to further processing, such as before labeling, shipping and handling to prevent subsequent container damage. To achieve such stiffening, a cryogen such as liquid nitrogen may be injected just prior to sealing. Injected as droplets, the liquid cryogen undergoes phase change to a gas, increasing the pressure inside the container, the increased pressure acting to stiffen the container walls.

Typically, the liquid cryogen drops or droplets, once injected, will coalesce as they sit on the container contents, the vaporization process taking anywhere from 5-15 seconds. Accordingly, the time between injection and container closure must be kept short. It is to be appreciated the exact time of vaporization may vary depending upon the size of the injected droplet, and the temperature of the container contents. The resulting pressure within the container will similarly be a function of the size of the injected drop, the free space to be filled, and the time between droplet injection and container closure.

Since the liquid nitrogen begins to immediately vaporize upon being dispensed, it is desirable to cap or close the container as soon as possible. Preferably, injection should occur immediately upstream of the closure station. However, because of the physical layout and limitations of conveyor systems used to bring containers to a capping or closure station, the size of the liquid delivery system head, and the configuration of the closure station itself, it is presently necessary to inject the liquid nitrogen a distance upstream of the point of closure.

Typical of liquid injection delivery systems developed for injection of small amounts of nitrogen into containers as they pass along an assembly line are those sold by VBS International, Inc. of Campbell, Calif., under the trade names LCI-300, 400, and 2000M. See also U.S. Pat. No. 6,182,715 to Alex R. Ziegler, et al, which patent is incorporated herein by reference in its entirety.

In these systems, a stream of liquid cryogen droplets is dispensed vertically into a moving container. In so doing, the force of injection can cause the droplets to substantially penetrate the surface of the container contents. The force of impact can result in splash-back of the contents onto the dosing head, where the splashed liquid may accumulate and later interfere with the operation of the dosing head itself.

Conveyer systems are run at fairly high speeds where containers pass by fixed stations at the rate of 500 units per minute or more. In fact, some processing conveyor lines run to speeds in excess of 1500 to 2000 containers per minute. At lower speeds, e.g. 500 units per minute, the liquid nitrogen feed systems of the referenced prior art perform well. However, at higher line speeds, the dispensing assemblies must operate at higher frequencies. Pneumatically driven valves such as those used in the dispensing systems of VBS to meter dose amounts produce heat proportional to their speed of operation, the pressure of the gas source, and frictional loses. As a result, heat tends to build up as the pneumatic valve is more rapidly cycled.

To date, it has been problematic to operate at the higher conveyor speeds of 1000 to 2000 containers per minute. In fact at such operational speeds, the pneumatic system gets hot to the touch (140° F.-160° F. and above), seals may fail and the unit burn out over the course of a day. Further, these delivery systems frequently are installed in assembly line areas where ambient temperatures may easily exceed 40° C., reducing the potential for effective ambient cooling.

With such high speed lines where containers pass a fill point at the rate of upwards of 1000 to 2000 units per minute, the residence time at the liquid injection station also becomes a factor, with the time allowed for fill becoming shorter than the time required for delivery of the dispensed liquid dose stream. This mismatch can result in a good portion of the injected dose missing the container opening, and thus lost to the atmosphere by vaporization. As a further result, maintenance of dose accuracy and repeatability can be lost.

There thus remains a need to develop delivery systems which are less prone to clogging through splash-back, and able to more accurately and efficiently deliver a measured dose of cryogen to a container to be pressurized. There also remains the need to shorten the dispensing cycle time of existing liquid delivery systems so as to match the higher speeds of current conveyor systems. So too, there remains a need for these systems to be able to operate in harsher temperature environments, such that the surrounding ambient will have little to no effect on operations.

SUMMARY OF THE INVENTION

By way of the present invention, a displacement assembly is provided which allows for the offset of the liquid injection point. In providing such an offset, the injection point can be placed proximate to a point immediately upstream of a closure station. As a secondary benefit, much of the vertical force of injection is dissipated as the delivery path of the cryogen is changed to first run horizontally for a select distance before being redirected vertically for injection. In so doing, the cryogen droplets hit the surface of the container contents with substantially less energy, thus significantly reducing, if not nearly eliminating, the tendency for liquid splash-back. As a still further benefit, by placing the injection head next to the container sealing position, the time lapse from injection to closure is greatly reduced, thus reducing the amount of pre-closure evaporation, which in turn permits the use of smaller amounts of cryogenic liquid per dose.

The invention covers both an apparatus for horizontally displacing the injection point for cryogen liquid delivery and a method for affecting the delivery of a cryogenic to a container immediately before closure. The displacement assembly itself can be incorporated as part of the overall liquid delivery system, or can be provided as a retrofit for liquid delivery systems already in use, to allow for dispensing closer to the point of container closure than previously possible.

The displacement method comprises the steps of metering a measured dose of liquid from the liquid delivery system, providing a substantially horizontally disposed pathway from the point of dosing to a remote dispensing point a measured distance from the first point. In one embodiment the pathway may be heated. In this embodiment, not only is sticking of cryogenic liquid onto the walls of the pathway prevented, but atomization of the liquid droplet stream occurs as well, which atomization serves to further reduce splash back and improve dose accuracy. In another embodiment, a gas can be introduced into the pathway at an upstream point to provide additional positive pressure behind the dispensed droplet stream to further promote travel along the horizontally disposed pathway to the point of injection.

In another embodiment of the invention, a sensor is provided to monitor droplet injection. The sensor generally comprises a pair of opposing optical fibers which can be positioned along the displacement assembly. The one fiber is connected to a light source; light emitted from the first fiber directed to the second fiber, which itself is connected to a sensor for measuring the intensity of the received radiation. The sensor in turn in connected to a monitor, whereby when a droplet, is discharged from the dosing head and enters the transport pathway, its passage will interrupt the light beam passing from the first optical fiber to the second optical fiber. By detecting the drop in measured intensity of the transmitted light, and noting the time of signal interruption, one can correlate the passage of a droplet to a given opening/closing cycle of the needle valve of the dosing head, thus confirming for a given open/close cycle that a droplet was discharged. The system can be programmed such that failure to detect a beam interruption will trigger an error signal, which can be set to automatically shut down the system, or generate an alarm for notifying an operator, who can then initiate remedial action.

Alternatively, the optical fibers of the sensor can be positioned orthogonal to the droplet discharge path, anywhere along the path. In this configuration, the interruption of transmitted light occurs only for that interval of time that a droplet stream passes between the fibers. By measuring the length of time of signal disruption, and knowing the diameter of the transport path, not only can droplet discharge be confirmed, but the volume of the droplet calculated as well. As with the first embodiment, the absence of a break in the detected beam in conjunction with the opening and closing of the needle valve of the dosing head creates an error signal, which alerts the operator to shut down the system.

Common causes for failure to discharge include a freeze-up of the discharge head, or a blockage of the cryogenic supply line upstream of the dosing head. This problem can be addressed by back flushing or purging of the system with a heated gas to melt whatever frozen liquid occlusions may have formed in the delivery system. In this embodiment, the horizontal displacement assembly, provided with internal heating units, heats a reverse flow of pressurized nitrogen gas which can be introduced near the discharge end of the assembly. Introduced under a positive pressure relative to the pressure in the dosing head, the heated nitrogen will flow back to and through the dosing head, and the cryogen source lines, the heated gas serving to melt any upstream blockage. By monitoring system pressure, such as at an upstream vent, and observing the point at which the system pressure reaches steady state, the end point of the back-flushing process can be determined.

In the cryogen dosing units employed with the present invention, a pneumatic actuator is used drive the needle valve, the actuator including a solenoid valve to regulate the flow of gas to a piston which in turn controls the opening and closing of the needle valve of the dosing head. In order to increase the operational speed of the liquid dosing assembly, it is possible to thermally manage the unit by positioning the solenoid valve in close proximity to the piston such that it makes thermal contact. The solenoid valve itself is cooled by the expansion of the gas used to drive the piston, as it is exhausted. This cooling effect is used to offset the heat generated by the rapid cycling. By utilizing the cooling effects generated by the solenoid valve in the operation of the needle valve, the needle valve can be operated much more rapidly without resultant overheating.

In yet another embodiment of this invention, exhausted nitrogen gas is used to further cool the actuator assembly by passing it over the assembly before being exhausted from the system. Still further, the assembly can be enclosed by a walled container such as a cylindrical housing, the interior of which is open to atmosphere, i.e., maintained at atmospheric pressure. The cooled nitrogen exhaust gases are passed through the enclosed space to cool the ambient immediately surrounding the actuator, thus providing further, more distributed cooling of the actuator assembly.

As an advantage of this arrangement, a small, compact dispensing head may be provided. As a further advantage, by cooling the actuator using the cooling effect of the expanding exhaust gas from the solenoid valve, the actuator is able to run at much higher cycles. In fact, it can be operated at up to 1000 to 2000 cycles per minute, without overheating, or burning out over long periods of operation. As a still further advantage of the assembly of this invention, the dispensing head may be operated in warm environments, such as may be encountered on a factory floor, the actuator thermally insulated from the higher ambient by the cooled housing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 5B and 5C are top and side views, respectively, of the displacement assembly of FIG. 4D, FIGS. 5A and 5D being sectional views, respectively, of the same assembly taken along the section lines illustrated, and FIG. 5E being an end view thereof.

DETAILED DESCRIPTION

The Horizontal Displacement Assembly

Figure 1:
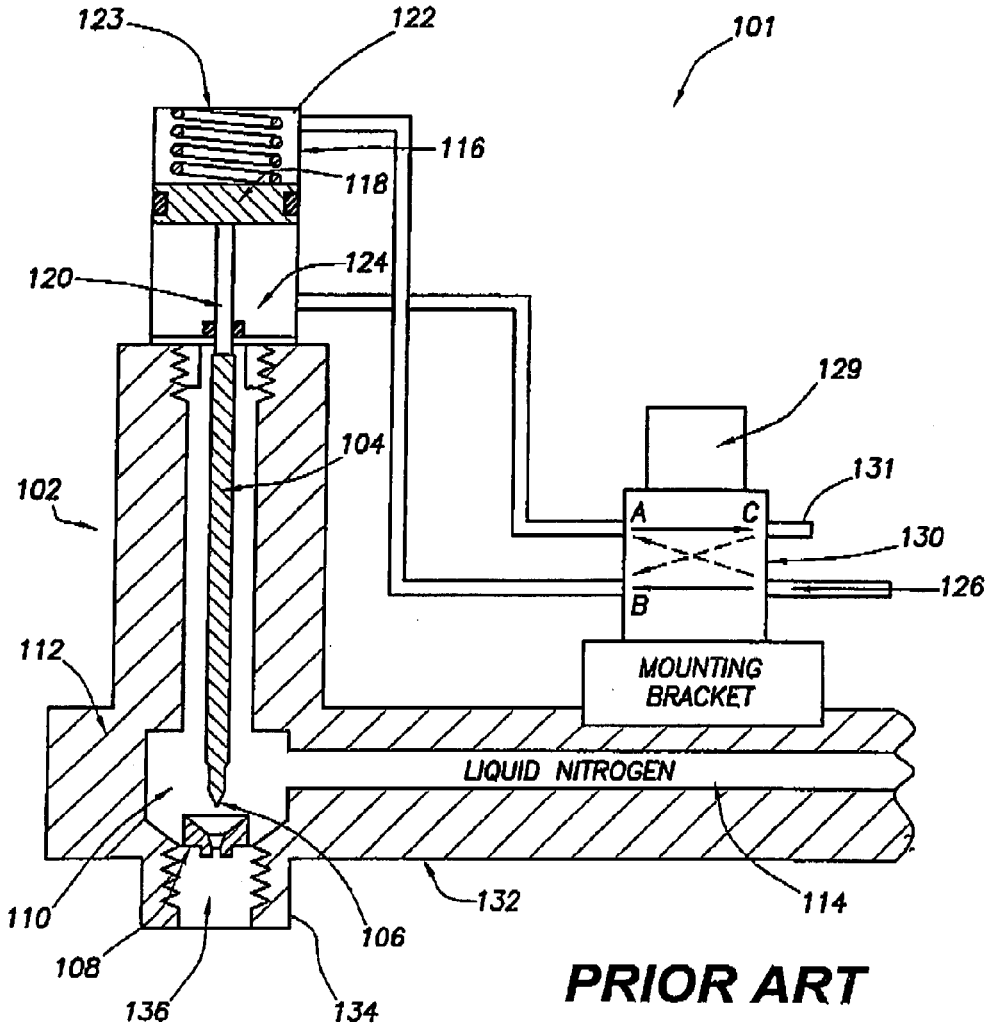
FIG. 1 is a cutaway view of a cryogen dosing system manufactured by VBS for use with the displacement assembly of this invention.

A typical dose assembly 101 sold by VBS is illustrated in FIG. 1, whereby droplets of liquid nitrogen are metered from a dosing head 102. The dosing head 102 includes a needle valve system for dispensing of the liquid nitrogen, the needle valve including a valve stem 104, with valve head 106 at its distal end, the valve head 106 sized for sealable engagement with valve seat 108. Reservoir 110 defined by valve body 112 acts as a local liquid cryogen supply chamber for holding liquid cryogen, inundating the seating area of the needle valve. Liquid nitrogen is fed to reservoir 110 through source conduit 114, extending from flexible dosing arm 132. It is contained in chamber 110 at slightly elevated pressure, e.g. 1 PSI above atmospheric. In a passive system, the pressure is created by the hydrostatic head of a larger cryogen source reservoir (not shown) placed above and supplying conduit 114. This liquid nitrogen supply may be pressurized, if desired. Typical pressures can range from near zero to 10 psi above atmosphere, with 6 psi being a customary upper limit. With the valve open, liquid nitrogen will flow through the metering orifice in valve seat 108, the flow interrupted when the valve is closed.

In order to precisely meter the amount of nitrogen dispensed into each container, it is important to be able to quickly open and close the dosing valve. This is achieved with a pneumatic actuator of the type shown in FIG. 1. Therein, and by way of illustration, valve stem 104 is secured at its proximate end to the end of a pneumatically actuated piston 116. The piston includes a piston head 118, a stem 120, upper and lower chambers 122 and 124, and ports for sequentially injecting and exhausting a gas such as nitrogen into both the upper and lower chambers to cause movement of the piston either upwardly or downwardly, in turn moving the needle valve to either the open or closed position.

The actuator may be spring loaded to bias the valve to the closed position. With the valve open as shown in FIG. 1, the lower chamber 124 of the pneumatic piston is pressurized, the upper chamber exhausted to atmosphere via vent 131. To lower valve head 106 and thus close the valve, upper chamber 122 is pressurized by flowing gas into that chamber, while the lower chamber is exhausted to atmosphere.

To effectuate such rapid opening and closing, the piston is driven by a 4-way solenoid valve 130 which controls the flow of nitrogen gas to the chambers above and below the piston head. As shown in the FIG. 1, this valve is separately mounted on dosing arm 132, some distance from the liquid nitrogen dispensing valve. In the mode illustrated, a pressurized source of nitrogen (or other inert gas) is supplied via supply line 126, the 4-way valve 130 biased in the closed position. When opened, the gas flows through the solenoid actuated valve to one of the piston chambers, to cause either opening or closing of the needle valve. The operation of the solenoid is controlled by a controller, not shown, which can be programmed to adjust valve cycle time, and thus control dose settings. Using the dosing assembly as above described, it is possible to rapidly introduce a cryogen liquid close to, but upstream of the container capping or sealing station.

Typically the containers are capped in a rotary capping station which receives the individual containers, and moves them in a circular path during the capping process. With the device of this invention, it is possible to bring the point of liquid injection within the footprint of the closure equipment. As previously noted, by facilitating the injection of the cryogen droplets immediately upstream of the sealing station, where closure is more immediate after injection, less of the cryogenic liquid will evaporate before container closure, thus allowing for the use of smaller amounts of liquid cryogen to obtain the same container pressures after sealing.

Figure 2:
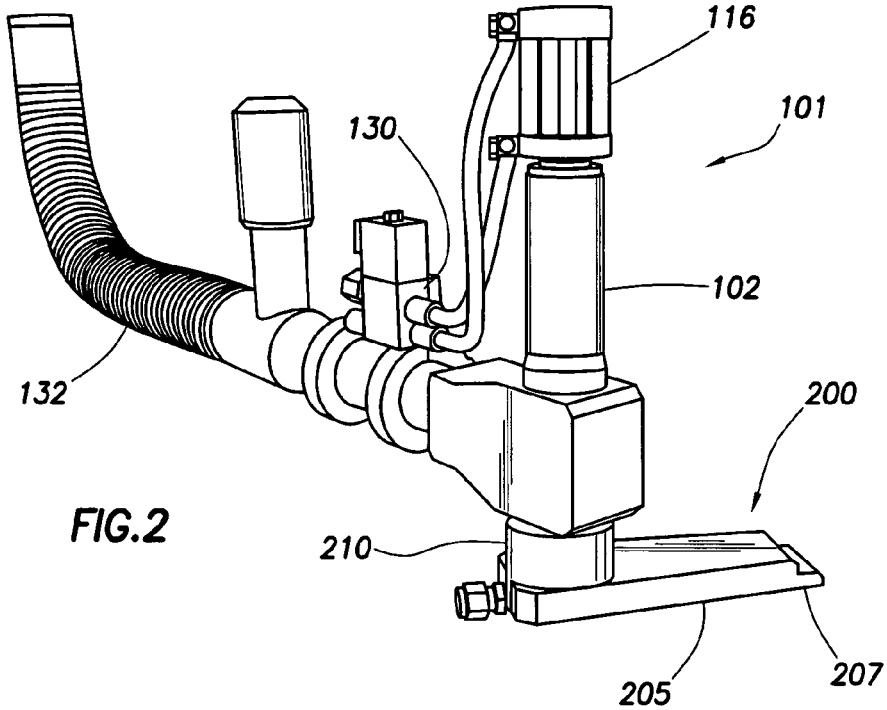
FIG. 2 is a front 3D view of the dosing assembly of FIG. 1 further incorporating a displacement assembly of this invention.
Figure 3:
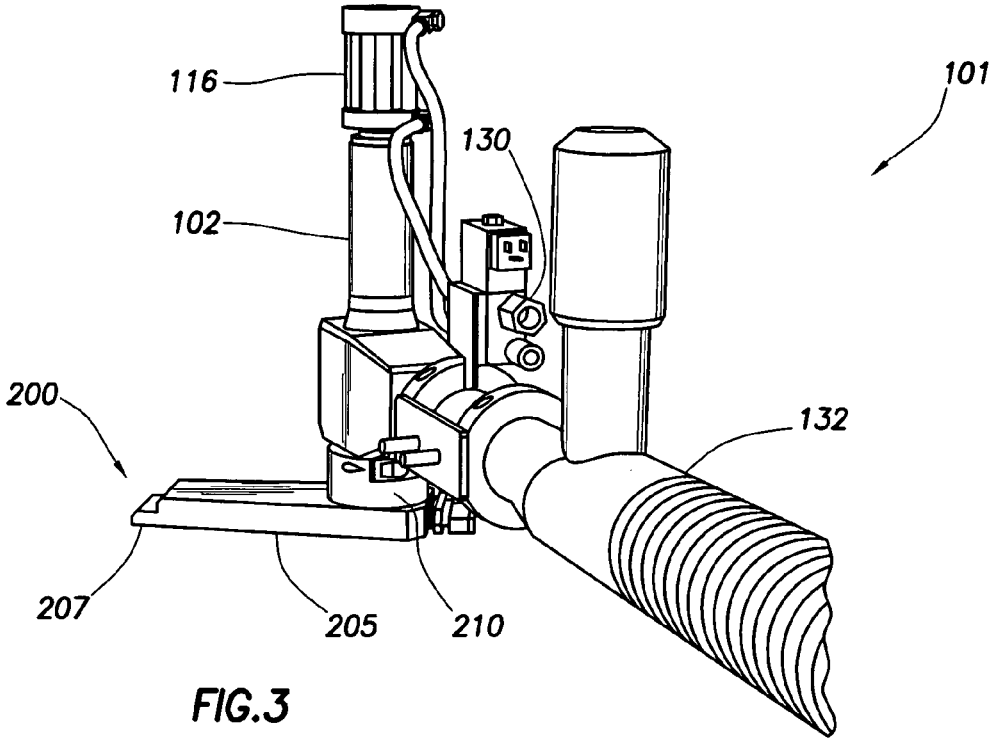
FIG. 3 is a rear 3D view of the displacement assembly of FIG. 2.

Referring now to FIGS. 2 and 3, a typical VBS micro dose dispensing head is illustrated in which a solenoid valve 130 is used to control the flow of liquid nitrogen to piston head 116, which in turn is used to drive and thus open and close the dispensing needle valve (not shown) which is contained within the housing of dosing head 102.

To move the injection point closer to the point of container sealing, the displacement assembly of this invention, as shown in FIGS. 2-5, can be used. The displacement assembly 200, affixed to the base of dosing assembly 101 comprises a generally elongate body 205 such as a rectangular block into which a hollow transport channel 209 has been bored there-through from a fist end 218 to a second end 220, for directing liquid cryogen horizontally along the bore to an injection port 207. At the injection port, the injection path is reoriented to the vertical for controlled droplet delivery into the container to be filled. In this arrangement, most of the downward velocity of the droplet introduced at metered dosing point 136 is dissipated as the droplet travels along horizontal path 209 to the injection port. By reducing droplet velocity into the container, the opportunity for splash-back is reduced, thus diminishing the likelihood splashed-back liquid will reach and freeze on the injection head, accumulating and eventually causing unit clogging.

Figure 4A:
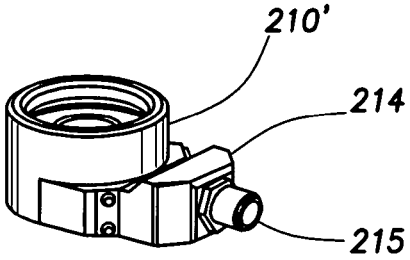
FIG. 4A is a 3D view of a heated collar which can be used with the dosing system of FIG. 1, FIGS. 4B-4D 3D views of various configurations of the displacement assembly of this invention.
Figure 4B:
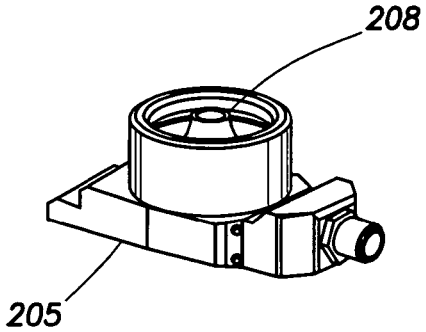
Figure 4C:
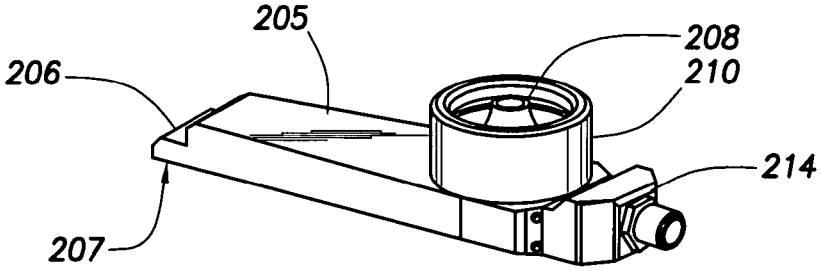

Various versions of the displacement unit are depicted in FIGS. 4B-C. With reference to the unit of FIG. 4D, block 205 is machined along its length to culminate in a smaller injection head 206, the reduced size allowing for placement of injection port 207 nearer to the point of container closure.

The illustrated assembly is configured to attach to the end of the metering unit, with connection collar 210 sized to engage extension 134 at the base of the needle valve. "O" rings 221, see FIGS. 4 and 5, are positioned within spaced grooves on the inner wall of connection collar 210. With the collar engaged with dosing head extension 134, the O rings serve to provide sufficient pressure against the peripheral wall of the extension to both prevent vibration and secure the horizontal displacement unit in place.

With reference to FIG. 4A, a prior art heated collar 210' designed for attachment to the end 134 of the dosing assembly is depicted. In this application, heating elements associated with the collar elevate the temperature of the collar so as to prevent freezing of splashed back liquid. In one application, the heating elements comprise an external heater affixed to the collar, in combination with a press fit bronze insert which receives and distributes heat across the collar.

In the present case, the heater is replaced by a displacement assembly mounted to the liquid delivery system using the same connection collar arrangement. Being configured with the same mounting system as the heater assembly, the displacement unit can easily be affixed to existing equipment already deployed in the field. It is to be noted that though the horizontal displacement unit may be retrofitted to dosing units such as that of FIG. 1, the displacement assembly may be designed to be integral to the dosing head, thus eliminating the need for connecting collar 210.

Over time, the cycling of liquid nitrogen at −196° C. through the block causes cool down of the block to the point where sticking of droplets (i.e., sticking to the walls of the bore) may occur during transit. To address this situation, in another feature of the invention, body 205 may be heated. Here, the body itself will be made of a material selected from any number of thermally conductive materials, and preferably those of relatively high thermal conductivity. Such materials include aluminum, bronze, copper, and brass. The use of these materials facilitates rapid response to increases or decreases in the amount of heat inputted to the block by the block heaters, thus facilitating tighter control of block temperature. The faster the response, the easier it is to fine tune block temperature.

A suitable heat source for the displacement assembly can include one or more resistive heaters 211 running a substantial the length of block 205. The temperature of block 205 is monitored by a thermocouple 212, which provides a signal representative of block temperature to a controller, which in turn is programmable to maintain a temperature set point by appropriately adjusting power to the heaters.

Figure 4D:
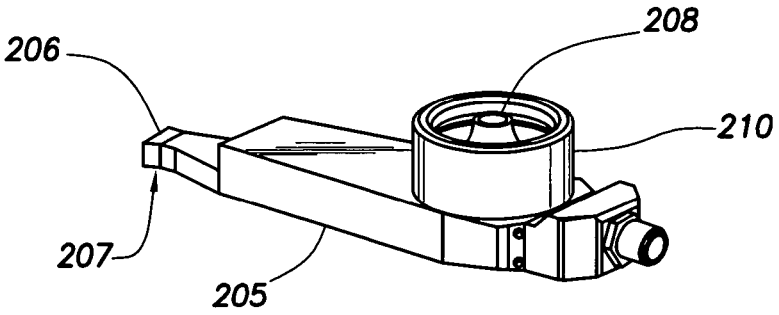

The heating arrangement is best shown in cross section 5D taken along line A-A of FIG. 5C, which itself is a top view of the displacement unit of FIG. 4D. There, each of the resistive heaters is electrically energized, internal wires 213 to the heaters covered by cap 214, and electrically joined to external connector 215. The amount of power to the heaters is regulated by a controller (not shown). Almost any type of elongate resistance heater may be used. Exemplary of commercially available heaters are cartridge component heaters available from Chromalox of Pittsburg, Pa. under the trade name CIR (Incoloy).

While two heaters are illustrated, it should be appreciated that the unit may be operated using a single heater. Also, other heating means may be used such as a heating blanket, or channels bored in the block through which a heating medium such as hot water can be flowed. However, with the electrical units described, a faster response to changes in temperature is possible and thus better control of block temperature achievable.

As the liquid nitrogen leaves the dosing head, a measured amount of nitrogen is dispensed in the form of a string of liquid droplets. While vaporization begins immediately, in the case of a heated unit, there is a spike in the vaporization rate as the droplets reach the heated inner walls of the transport pathway of the displacement assembly. This rapid increase in vaporization rate results in a sharp rise in pressure in the transport pathway, greatly accelerating the transport of the liquid droplets to the second end of the pathway for injection into a container. As a consequence, the injection period is greatly compressed, such that all of the dosed droplets are injected into the container during that interval of time the container opening is in residence below injection port 207. It has been observed that the time compression of the dispensing period can be as much as 80%. In the past, with the systems of the prior art, the dosing period was much longer, such that much of the liquid to be injected arrived at the container opening either before or after the opening was in position to receive the liquid. By compressing the period of injection, almost all of the dispensed dose is injected into the container, thus increasing dosing accuracy, efficiency and repeatability.

It is to be noted that operated in the manner described above, both ends of the transport passageway are initially open during dispensing of a given dose. That is, the needle valve is in the open position with the valve head 106 displaced from valve seat 108 for a limited period of time to allow for flow of the desired amount of cryogen from the cryogen reservoir through the opening in the valve seat to the displacement assembly. During the time of dose transport, the needle valve head 106 engages with valve seat 108 to close off the receiving end of the transport path. By so closing the receiving end, while leaving the dispensing end open, the rapid buildup of pressure caused by the vaporization of the heated cryogen acts on the metered dose to accelerate it in the one available direction, toward the open, discharge end of the passageway. By proper scheduling of the opening and closing of the needle valve, the receiving end of transport pathway can be kept closed during the entire time of dose transport.

For a unit as depicted in FIG. 5, given a displacement length of approximately 4," it has been found that sticking of the dispensed droplets in bore, i.e. transport channel 209 can essentially be prevented by maintaining block temperature between a few degrees above room temperature to about 140° F. Preferably large temperature swings should be avoided, and temperatures maintained in a narrower range, such as for example between 90° F. to 100° F.

For the displacement assemblies of FIGS. 4C and 4D, a dose capture guide 208 is provided to collect the cryogen droplets as they are dispensed from dosing head 102 of dispensing assembly 101, to capture the droplets and direct them through dose receiving port 222 to transport pathway 209. Bore 209 is most commonly of circular cross section, and is disposed substantially horizontally. Preferably, as illustrated in FIG. 5A, it can be angled slightly downward, such as for example by about 3 degrees±1 degree from the horizontal to assist in the flow of cryogen droplets through the transport passageway to dispensing port 207. Typically the slope angle can be varied a few degrees, for example between 0° and 10°. At higher slope angles, a thicker block is required to define a channel of equal horizontal displacement, the thicker block potentially impeding placement of the injection head 206 adjacent the point of container sealing, due to dimensional constraints of the conveyor and/or the sealing unit. At shallower angles, e.g. 0 degrees, the dispensed droplet will not as easily transport along pathway 209 without the application of an alternative displacing force. In one alternative, this force can be applied by simply turning the flexible dosing arm to thus tilt the dispensing assembly a few degrees. In another, the displacing force can be provided by introduction of a pressurized gas to the system, or vaporization of the metered cryogen by application of heat to induce a pressure spike.

In one embodiment, a constant positive pressure can be created within the displacement assembly, wherein a gas feed line (not show) is provided which connects to a gas inject port 216, the port introducing gas into channel 209 at a point upstream of where dispensed droplets enter the channel. It should be understood that a variety of gases can be used, but preferably one which does not form a reaction product with the cryogen liquid, nor constitutes a contaminant to the container contents. In one embodiment the gas of choice is nitrogen, though other inert gases such as argon can be used.

By way of example, for a system such as that of FIG. 5, in which the horizontal displacement is about 4 inches, and the bore diameter is about 0.150 inches, a gas flow rate of 1-5 standard cubic feet per hour has been found to be effective. The primary requirement is that the pressure applied be sufficient to further sweep the dispensed droplets forward along transport passageway 209 to the dispensing port. The temperature of the injected gas is not critical, and may be injected at room temperature. In one embodiment of the invention, the gas pressure applied to bore 209 is applied continuously. It may, however, be applied intermittently, the gas flow timed to sequence with the dispensing of a metered droplet into the transport passageway.

FIG. 4B is a depiction of yet another variation of the displacement assembly, having a shortened block 205. In this embodiment, foreshortened for less horizontal displacement, the primary purpose in using the displacement block is to reduce splash-back in conveyor systems where the insertion point is neither critical nor particularly constrained. Generally the length of the displacement unit and the size of the injection head can be varied and tailored to meet the dimensional requirements of the system in to which it will be placed for container filling. The only functional requirement is that the length of the displacement assembly be no longer than needed to bring the injection point to a location immediate to the station where container closure occurs.

With the filling process using the heated assembly of this invention, it has been observed that droplets from the dosing head tend to become atomized due to the rapid increase in pressure within the transport channel. This break up of the droplets into finer droplets in the displacement assembly results in a droplet stream which, when injected, causes far less splash back of container contents. It is believed in the process of injecting a finer stream of droplets, the net force of injection remains the same, though dispersed over the multiple droplets, such that the force per droplet is much less, resulting in far less penetration of individual droplets into the container's liquid contents. With direct, vertical injection, where splash back is of concern, the splash back material can also include some of the dispensed liquid nitrogen. Such loss of liquid nitrogen can result in variance of cryogen dose from container to container, leading to a variance of pressure within individual containers after capping. By carefully controlling dose delivery, and eliminating splash back, more repeatable dosing is achieved with each of the containers to be filled.

In another application for the invention, the displacement assembly may be used for injection of liquid nitrogen droplets into containers such as gas tight packages before they are sealed to provide an inert atmosphere within the sealed package. Typical packages for the use of inerting atmospheres include potato chip bags, foil coverings for individual tea bags, and the like. By displacing the air/oxygen before sealing, freshness of the contents is preserved over a longer period of time.

In the foregoing application, the small liquid droplets can be injected horizontally either in a straight-forward path, or at right angles (side to side) to the initial direction of travel of the droplets, vertically, both up and down or in several directions at once. In fact the injection head can be designed to redirect the liquid flow path from one which is coincident to the horizontal central axis of the displacement unit to any path that is neither concentric nor coincident with the horizontal central axis.

For ease of manufacturing, injection head 206 can be machined as a separate component, the pathways first formed in head 206, and the head then attached to elongate body 205 of the displacement assembly. Head 206 can be secured by a variety of attachment means, such as by welding, gluing, screws or other mechanical fastening devices.

Fluid Dispensing Sensors

Figure 6A:
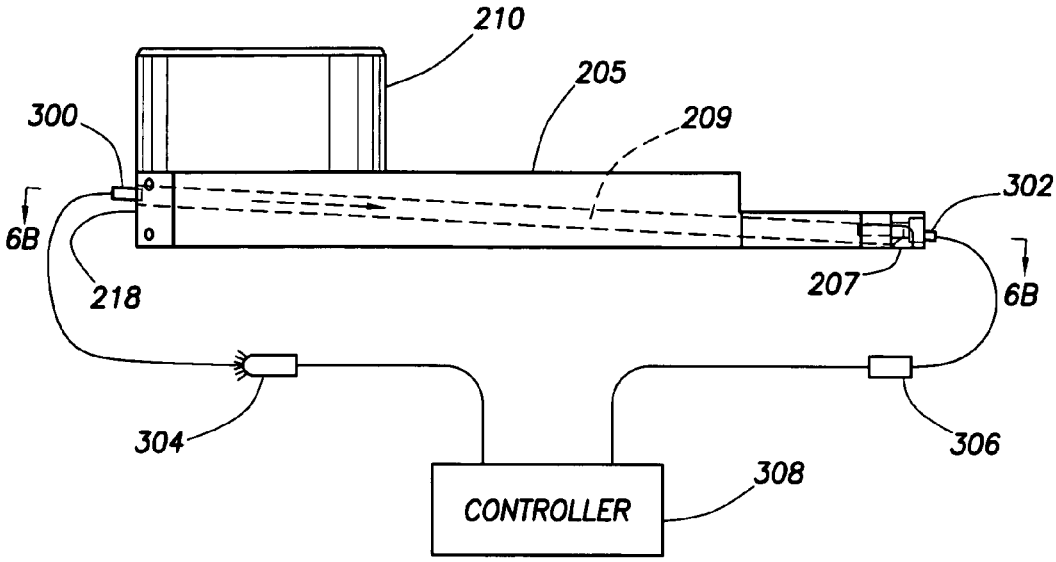
FIG. 6 is a sectioned top and side view of the displacement assembly of FIG. 4C incorporating the optical sensor system of this invention.
Figure 6B:
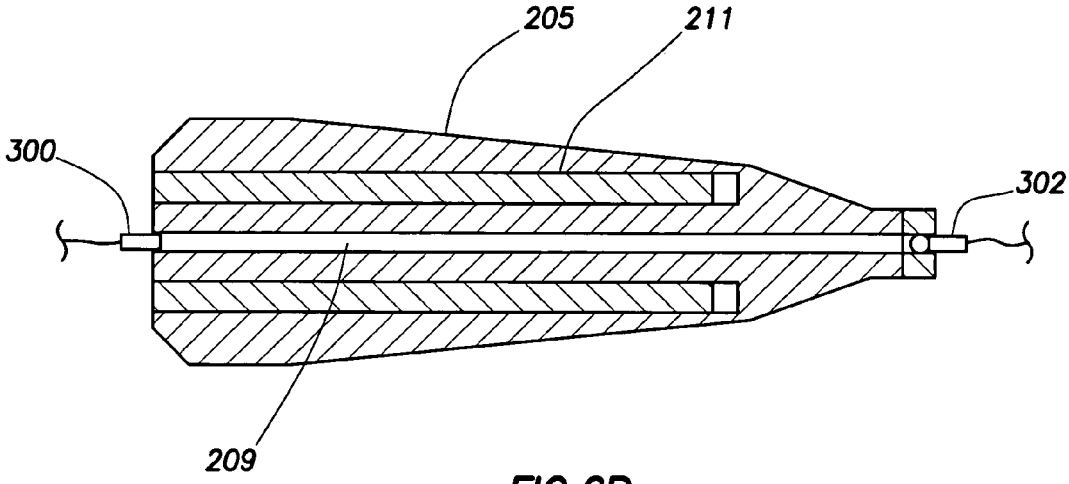

The fluid dispensing sensor of the invention will next be described with reference to FIGS. 6, and 7. In FIG. 6, a sensor is shown having a fiber optic cable 300 attached to the first end 218 of the horizontal displacement assembly, a second fiber optic cable 302 attached to the end of discharge pathway 209 of displacement unit 205, in alignment with the face of the first fiber optic cable. The optical fibers are can be made from glass, plastic or other optically clear materials, and are commercially available from such companies as Banner Engineering.

A light source 304 is connected to the first fiber to provide a light beam, the presence of which will be detected by the second optical fiber. Suitable light sources include an LED. The optical fibers are positioned such that as soon as a liquid droplet from the dosing unit reaches displacement pathway 209, the light from the first fiber will be interrupted, and will remain so until the droplet is discharged via injection port 207. A commercially available fiber optic sensor 306, such as one sold by Banner Engineering under the designation Omni-beam, attached to the end of the second optical fiber converts the detected beam of light into an electrical signal, the strength of the signal proportional to the intensity of the transmitted beam. By detecting the drop in signal strength, the sensor signals the system's computer controller 308 that a discharge event has occurred. This signal should follow in sequence a signal from the computer controller to open the needle valve by activation of the solenoid. By confirming after each open valve command, that a drop in transmitted light intensity has occurred, liquid discharge from the displacement assembly is confirmed. That is, for each open/close cycle of the dispensing needle valve, either a droplet was determined to be "present" or "not present" in the displacement pathway. So long as the presence of a droplet is detected, the dispensing cycle will continue to the next open/close cycle of the dispensing needle valve.

At such time as there is no loss in signal strength, and thus a "not present" condition encountered, controller 308 will issue an error signal. The unit can be programmed to either shut down further processing, or generate an alarm to alert an operator that a "not present" event has occurred. At this point, the operator can shut down the system, and investigate the cause, taking remedial action as appropriate. In the event that the heaters in the displacement assembly were to fail, and droplets freeze up in transport pathway 209, the opposite condition would occur. That is a continuous "present" condition would exist, and the controller can be programmed to flag such a continuous condition and similarly issue an error signal.

Figure 7A:
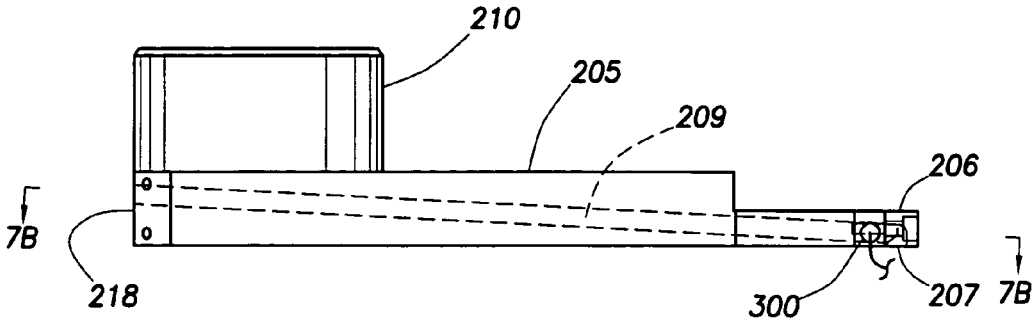
FIG. 7 is a sectioned top and side view of the displacement assembly of FIG. 4C illustrating an alternative positioning of the optical sensor of the invention.
Figure 7B:
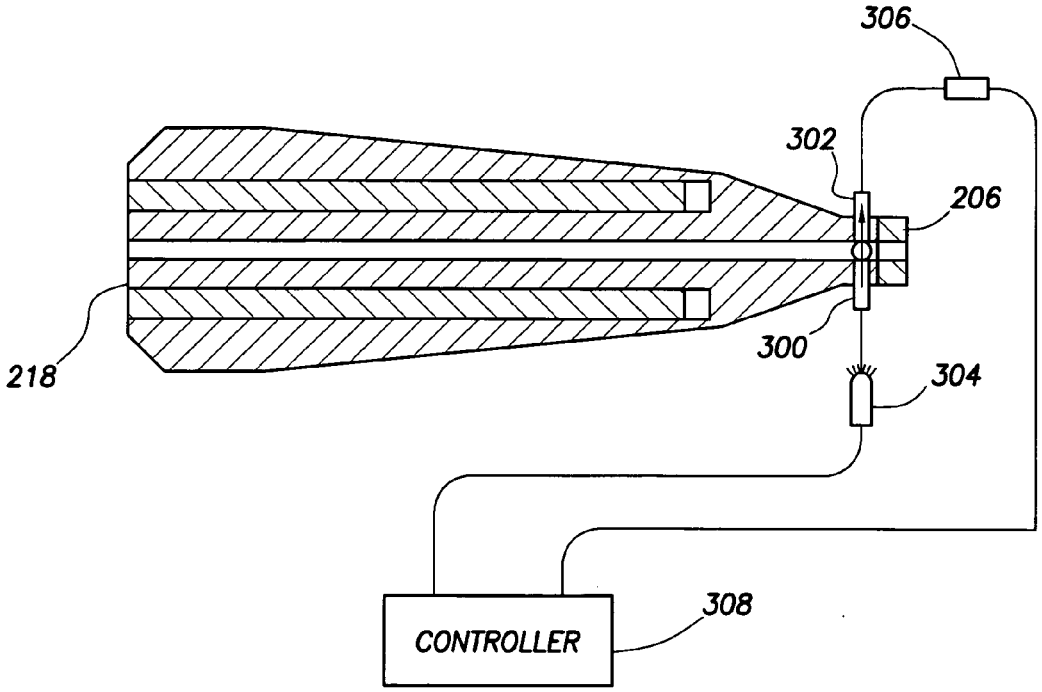

An alternative sensor arrangement is shown in FIG. 7. Here, the optical fibers 300 and 302 are positioned along the displacement path 209, orthogonally to the direction of fluid flow, preferably near the tip of the displacement assembly, at injection head 206, as illustrated. In this alternative, the time period of decreased light intensity is directly proportional to the size of the droplet stream moving across the displacement path. The longer the period of light beam interference, the larger the droplet stream, and vice versa. Knowing the diameter of the displacement path, the period of beam drop off, the displacement assembly temperature, and the dispensing pressure, one can calculate the volume of the dispensed droplets using the associated system controller 308.

System Purging

Figure 8A:
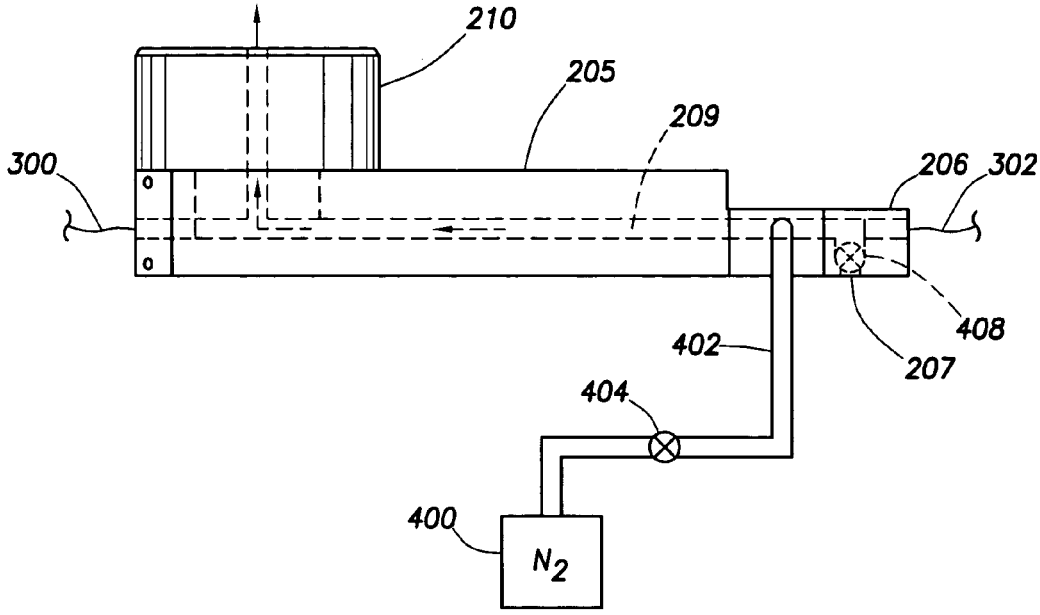
FIG. 8 is a schematic view of the dosing system employing a back purge feature of this invention.
Figure 8B:
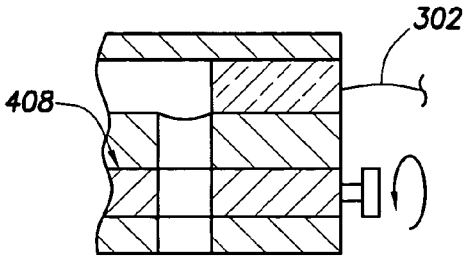
Figure 8C:
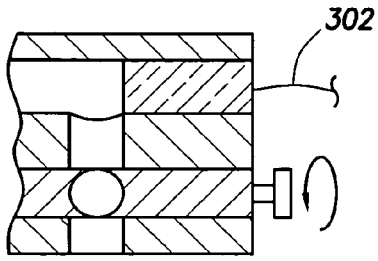
Figure 9A:
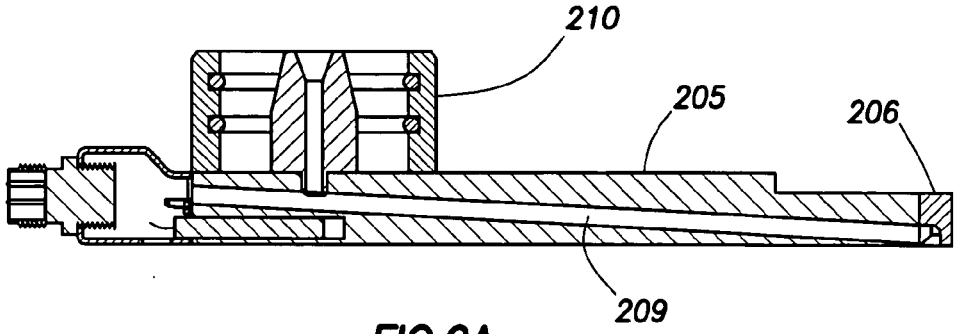
FIG. 9 is a schematic view of the dosing system including the back purge feature, employing an alternative means for sealing the end of the displacement assembly.

Typical droplet dispensing failure causes can include clogged lines, disruption of the supply of liquid nitrogen, exhaustion of the liquid nitrogen supply or loss of pressure within the dispensing system. In the case of clogged lines, one remediation technique is to back flush or purge the needle value and liquid nitrogen supply (i.e. source conduit) lines with heated nitrogen gas. Such can be accomplished using an assembly such as illustrated in FIG. 8 or 9. In FIG. 8, an external pressurized source of nitrogen 400 is plumbed to the displacement assembly, via conduit 402, which is connected to displacement path 209 near the discharge end of displacement assembly 205. Flow to the displacement path is controlled by cut-off valve 404.

Before beginning to flow nitrogen from source 400, the end of the displacement path must first be closed off. This can be done in any number of ways known to the prior art. In the embodiment depicted in FIG. 8, a stopcock type valve 408 is positioned in-line within displacement path 209. In operation of the dispensing assembly, the valve as shown at FIG. 8B is in the open position. When back-flushing the system, the valve as shown in FIG. 8C is rotated 90° to close the pathway, and thus contain the flow of nitrogen gas within the system.

While nitrogen source 400 may be externally heated, it is preferred to use the embedded heaters 211 of the displacement assembly to heat the gas. By introducing the same near the discharge point, the maximum residence time for gas heating in the assembly is afforded. The heaters can be run at the same temperature used during dosing operations, e.g. about 130° F., or adjusted upwardly to temperatures as high as 250° F. At temperatures above 212° F., any water that may be in the system will also be dissipated.

To affect a back purge of the system, the remote source of liquid nitrogen is first turned off. Valve 408 is closed, and valve 402 opened, to start the flow of gaseous nitrogen, the heaters set to the desired temperature. Once the displacement assembly is pressurize, the needle valve can then be opened. The gaseous nitrogen need be pressurized only to the point of providing a positive back pressure such that the heated gas will flow past the needle valve, into the cryogen source conduit 114. A system vent positioned along the flexible support arm, downstream of the system's cryogen source reservoir can be monitored for gas discharge. This vent line is valved such that when the valve is closed, cryogen flows from the cryogen source to the dosing head, and when opened, the source conduit vents to atmosphere, flow form the cryogen source now stopped. If there is an obstruction in the line, the heated nitrogen gas will not vent. At such time as heated gas melts whatever occlusions may exist, gas will start to flow and the measured gas pressure at the vent increase. When the increase in gas pressure reaches steady state, the back flush operation can be stopped. Alternatively, one can monitor the pressure downstream of the metered dosing point 136. In this embodiment, one can locate a pressure tap in the transport passageway anywhere along the pathway length. When back flush is first begun, an increase in pressure will initially be observed if the occlusion is upstream of the sampling point. On the other hand, one will initially observe no increase in pressure if the occlusion is downstream. At such time as the occlusion is removed, the measured pressure will reach a steady state, indicating that the end of the purging process has been reached.

Figure 9B:
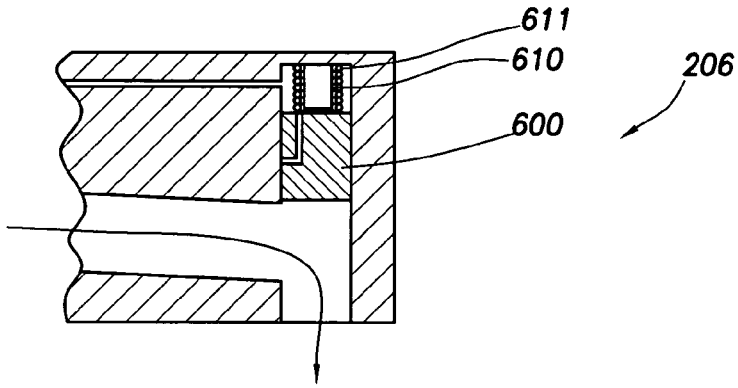
Figure 9C:
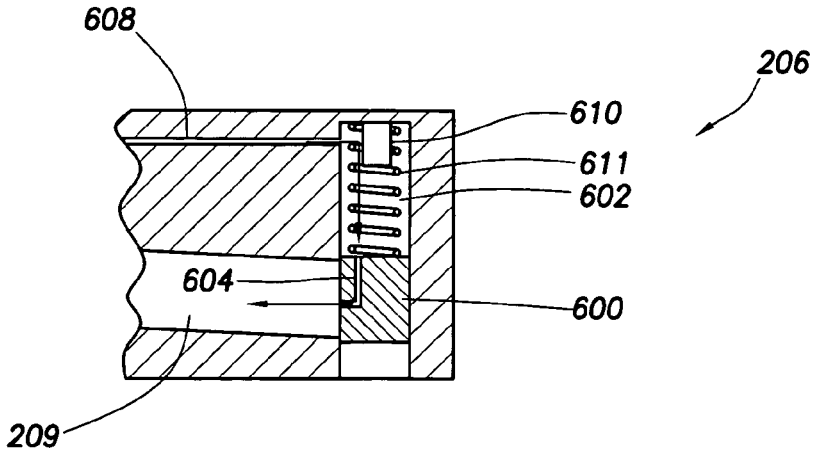
Figure 10:
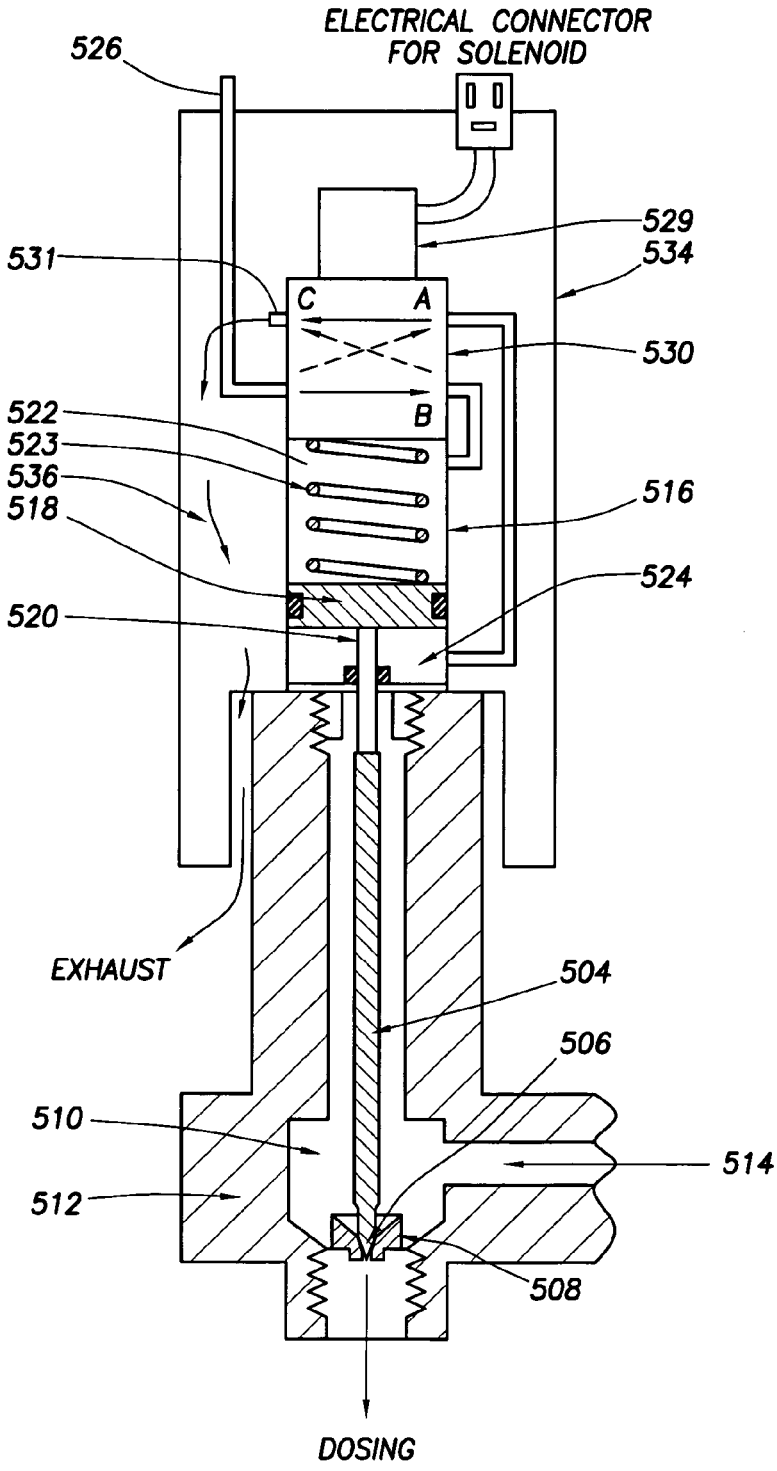
FIG. 10 is a cutaway view of an alternative arrangement of the dosing unit, in which the solenoid used to drive the pneumatically actuated valve is shown in thermal contact with the actuator.

In an equivalent, but alterative set up to that shown in FIG. 8 is illustrated in FIG. 9, in which a moveable cylinder 600 is fitted in the end of the injection head 206, with it's central axis parallel and concentric to the discharge end outlet. The cylinder is partially sealed in a cavity 602 that is connected to a controlled nitrogen source 400 through internal conduit 608. In addition, the cylinder has a conduit 604 beginning central to its axis, boring to half the total length, and then exits perpendicular thereto. Post 610 serves to space cylinder 600 from the end of the cavity, such that gas from conduit 608 can flow into said cavity with the cylinder in the open or dispensing position as shown in FIG. 9B. Spring 611, surrounding post 610 and affixed at one end to the wall of cavity 602, is affixed at its other end to cylinder 600. The spring serves to bias the cylinder in the closed position, limits its downward movement in the cavity under the influence of the pressure from the introduced nitrogen gas, and causes the cylinder to retract when gas flow is discontinued. A protrusion (not shown) can also be provided on the wall, near the lower end of cavity 602 to further limit the downward movement of cylinder 600. When a sufficient supply of gas has been introduced into the cavity, the position of cylinder 600 will shift to the closed position illustrated in FIG. 9C, blocking off the normal outlet and allowing gas conduit 604 to move into fluid engagement with displacement passageway 209, thus allowing for the initiation of back purge flow. The needle valve of the pneumatic actuator must be open for any flow to occur. In addition, a tap (not shown) measures the pressure in delivery conduit 608. This allows for detection of an occlusion by means of a pressure switch which compares occluded versus clear, that is unblocked, flow. (If the pressure is higher than a particular set point, an occlusion is indicated. When the occlusion is eliminated, the pressure will drop).

Cooled Pneumatic Actuator

In an embodiment of the invention, a thermally managed actuator assembly can be provided as shown in FIG. 9, the dosing assembly similar to that of FIG. 1. Herein, piston 516 is connected to a needle valve assembly including a needle valve stem 504 having at its distal end a valve head 506 configured to mate with valve seat 508 when in the extended or closed position, as shown. Valve seat 508 includes a metering orifice which is in fluid communication with the cryogen reservoir 510. With the valve in the open position, a small amount of cryogen can pass from the reservoir through the orifice to be dosed to a container to be pressurized.

The displacement of the piston is generally kept to a minimum to facilitate more rapid cycling. All that is required for operation of the system is that the valve head be retracted a distance from the valve seat sufficient to clear the metering orifice, and allow for the free passage of the liquid nitrogen through the said orifice. Generally, in the VBS system described this is accomplished by limiting piston travel to about 0.200 inches.

With reference to FIG. 9, a standard 4-way valve 530 controlled by a solenoid 529 commercially available MAC of Wixom, Mich. is shown. The valve is situated immediately atop and in direct thermal contact with piston 516. The system is biased to the closed position by spring 523. At start up, a pressurized gas (e.g. at 60 psi) such as nitrogen, is fed through input line 526 to 4-way valve 530, which directs the gas flow through line B to the space above the piston head, with line A open to exhaust port C of the valve assembly. To open the metering valve, solenoid 529 is activated to change the flow paths within the 4-way valve, redirecting the gas flow, such that nitrogen gas now flows through line A to the lower chamber of the piston, acting against the force of the spring 523. Simultaneously line B connects to exhaust C, thus allowing for the vertical displacement of the needle valve relative to the valve seat. This open/close cycle is rapidly repeated to effect metered liquid dispensing.

The solenoid valve, mounted in thermal contact with the piston's cylindrical casing, can be mounted by direct physical contact, or to a seat (not shown) which is itself mounted directly the casing of the cylinder, the seat made of any thermally conductive material such as aluminum or copper. Notwithstanding its relocated position, the solenoid actuated valve operates in the same fashion to move the piston, and thus open and close the dispensing needle valve.

As the gas used to actuate the piston is exhausted from 4-way valve 530, it expands at the exhaust outlet 531. In expanding, it thermodynamically cools, thus cooling the solenoid 4-way valve assembly itself. It has been found that the cooling effect is quite substantial, the expanding exhaust gases cooling the solenoid valve from essentially room temperature to 5° C. or more below room temperature. By placing the cooled solenoid valve in thermal contact with the actuator assembly, the heat generated by its operation can effectively be balanced by the cooling or heat absorption capabilities of the solenoid assembly. It has been found that even at operational speeds of 2000 cycles per minute, the actuator can be operated without significant heat build up, thus facilitating its use with high speed conveyor systems. In the configuration of this invention it has been observed that running at 2000 cycles per minute in an ambient of 25° C., the actuator can still be maintained at a temperature as low as 20° C.

In an embodiment of the invention, the actuator assembly, including the solenoid valve, is placed within a housing 534, which has a restricted opening at one end to permit exhaust of gas to ambient. In the embodiment shown, the exhaust gas streams 536 pass over piston assembly 516 to provide further cooling of that assembly, and further acts as a thermal gas insulator between housing 534 and the outside ambient. In this way, the assembly can be operated in a warm or hot room, with lesser impact due to the surrounding ambient, thus further facilitating rapid, high speed operation without heat buildup. In fact, with the delivery assembly of this invention, speeds of up to 2000 cycles per minute can be achieved in elevated temperature environments, up to and including 80° C., without significant overheating.

In describing the invention herein, particular reference has been made to the use of nitrogen as the liquid cryogen, and as the feed gas for operation of the actuator. However, it should be appreciated that other gases can be used such as argon, or other inert gases. As the cryogen used to pressurize the containers, it should be appreciated that nitrogen is preferred due to its safety and efficacy for foods, beverages and cosmetic products. Other cryogenic gases may be suitable for pressurizing containers where it is intended they contain materials not intended for human consumption or application. Generally a wide range of the materials may be used for the construction for the pneumatic piston and solenoid valve assembly. Most important is that they include thermally conductive materials, especially at the surface of thermal contact to insure a thermal pathway for cooling of the actuator body.

While the foregoing is directed to embodiments of the present invention, other and further embodiments of the invention may be devised without departing from the basic scope thereof, and the scope thereof is determined by the claims that follow.

What is claimed is:

1. A method for dispensing liquid cryogen into a container prior to sealing, comprising;

forming droplets of cryogen liquid and dispensing them in a generally vertical direction from a dosing head;

providing a transport pathway for redirecting the flow of said dispensed droplets from the generally vertical to a generally horizontal direction, said pathway in fluid communication with said dosing head, and having a predetermined length defined by first and second ends;

positioning the transport pathway below the dispensing head so as to receive the droplets dispensed from said dosing head, directing the dispensed droplets to said pathway at a point near a first end of the pathway, transporting the liquid droplets along the length of the pathway to its second end; and, thereafter directing the flow of said liquid droplets for injection into a container;

wherein the flow of said liquid droplets is directed to a generally horizontal path for injection into a container.

2. The method of claim 1 wherein the flow of said liquid droplets is directed to a generally vertical path for injection into a container.

3. The method of claim 1 including the step of heating the transport pathway over a portion of its length.

4. The method of claim 1 including the step of injecting a gas near the first end of the transport pathway.

5. The method of claim 1 further including the step of detecting the presence of a liquid droplet in said transport pathway.

6. The method of claim 5, an error signal is generated if the presence of a liquid droplet is not confirmed.

7. An injection displacement assembly for transporting droplets of liquid cryogen from a liquid cryogen dosing head to a container, said injection displacement assembly including:

an assembly body of a predetermined dimension having a first end and a second end, a transport pathway internal to and running the length of said assembly body from said first end to said second end, said transport pathway having a central axis, a dose capture guide in fluid communication with said pathway near its first end to direct a droplet dispensed from the dosing head to said internal transport pathway;

and, an injection head extending from the assembly body at its second end and having therein an internal pathway in fluid communication with the transport pathway, to direct the liquid flow path to the point of injection, wherein the injection head redirects the liquid flow path from the central axis of the pathway to a direction at an angle to the central axis.

8. An injection displacement assembly for transporting droplets of liquid cryogen from a liquid cryogen dosing head to a container, said injection displacement assembly including:

an assembly body of a predetermined dimension having a first end and a second end, a transport pathway internal to and running the length of said assembly body from said first end to said second end, said transport pathway having a central axis, a dose capture guide in fluid communication with said pathway near its first end to direct a droplet dispensed from the dosing head to said internal transport pathway;

and, an injection head extending from the assembly body at its second end and having therein an internal pathway in fluid communication with the transport pathway, to direct the liquid flow path to the point of injection, wherein the injection head redirects the liquid flow path along the central axis of the pathway to a direction perpendicular to said central axis.

9. An injection displacement assembly for transporting droplets of liquid cryogen from a liquid cryogen dosing head to a container, said injection displacement assembly including:

an assembly body of a predetermined dimension having a first end and a second end, a transport pathway internal to and running the length of said assembly body from said first end to said second end, said transport pathway having a central axis, a dose capture guide in fluid communication with said pathway near its first end to direct a droplet dispensed from the dosing head to said internal transport pathway;

and, an injection head extending from the assembly body at its second end and having therein an internal pathway in fluid communication with the trap sport pathway, to direct the liquid flow path to the point of injection, wherein the injection head redirects the liquid flow path from the central axis to one that is not concentric and coincident with the central axis.

10. The assembly of claim 9 wherein the injection head redirects the liquid flow path from the central axis of the pathway to a direction at an angle to the central axis.

11. The assembly of claim 9 wherein the injection head redirects the liquid flowpath along the central axis of the pathway to a direction perpendicular to said central axis.

12. The apparatus of claim 9 wherein said assembly body is an elongate body.

13. The apparatus of claim 12 wherein the elongate body includes heater for heating said body.

14. The apparatus of claim 13 wherein said heater includes at least one electrical resistance heating element.

15. The apparatus of claim 12 wherein said elongate body includes a thermocouple embedded therein for measuring the temperature of the elongate body, and a controller for receiving a signal from the thermocouple representative of the elongate body temperature, said controller programmed to adjust power to the beater in order to regulate the temperature of the elongate body within a preselected range.

16. The apparatus of claim 9, further including means for injecting gas into the transport pathway proximate its first end.

17. The apparatus of claim 9 wherein the injection head has a reduced dimension section compared to the dimension of the elongate body from which it extends.

18. The apparatus of claim 9 further including a connecting collar disposed coaxial to the dose capture guide.

19. The apparatus of claim 9 in which the transport pathway is inclined downwardly from the horizontal.

20. The apparatus of claim 19 where the degree of incline is between 2° to 4° from horizontal.

21. The apparatus of claim 9 further including a sensor to monitor the presence or absence of a liquid droplet in the transport pathway.

22. The apparatus of claim 21 wherein the sensor comprises opposing optical fibers positioned along the transport pathway.

23. The apparatus of claim 22 wherein the optical fibers are positioned longitudinally at each end of the transport pathway.

24. The apparatus of claim 22 wherein the opposing optical fibers are positioned at a point along the transport pathway, orthogonal to said pathway.

25. The apparatus of claim 24, wherein the opposing optical fibers are positioned at the end of the transport pathway, at the injection head.

26. The apparatus of claim 9 further including means to close off the end of the internal pathway at the injection head, and means to introduce a gas into the transport pathway proximate said closed offend.

* * * * *